US006646372B2

(12) United States Patent
Taniwa et al.

(10) Patent No.: US 6,646,372 B2
(45) Date of Patent: Nov. 11, 2003

(54) DEFLECTION YOKE

(75) Inventors: Kenichiro Taniwa, Takatsuki (JP); Koichi Matsumoto, Minoo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/247,093

(22) Filed: Sep. 18, 2002

(65) Prior Publication Data

US 2003/0052588 A1 Mar. 20, 2003

(30) Foreign Application Priority Data

Sep. 19, 2001 (JP) ..... 2001-285457

(51) Int. Cl.[7] ..... H01J 29/70

(52) U.S. Cl. ..... 313/440; 335/211; 335/212; 335/213

(58) Field of Search ..... 313/440, 477 R, 313/421, 427, 428; 335/210, 211, 212, 213

(56) References Cited

U.S. PATENT DOCUMENTS

| | | | | |
|---|---|---|---|---|
| 5,434,484 A | | 7/1995 | Murakami | |
| 5,596,304 A | * | 1/1997 | Tatchyn | 335/306 |
| 5,804,928 A | | 9/1998 | Endo | |
| 6,373,180 B1 | * | 4/2002 | Azzi et al. | 313/440 |
| 6,495,951 B1 | * | 12/2002 | Kim et al. | 313/440 |

FOREIGN PATENT DOCUMENTS

| | | |
|---|---|---|
| JP | 6-315094 | 11/1994 |
| JP | 7-39163 | 9/1995 |
| JP | 9-149283 | 6/1996 |
| JP | 9-181931 | 7/1997 |
| JP | 10-326578 | 12/1998 |

* cited by examiner

*Primary Examiner*—Edward J. Glick
*Assistant Examiner*—Elizabeth Gemmell
(74) *Attorney, Agent, or Firm*—Merchant & Gould, P.C.

(57) ABSTRACT

A deflection yoke having a capability of correcting a lateral inner pincushion distortion with a magnetic field generated by a deflecting coil itself is provided. The deflection yoke includes a saddle-type vertical deflecting coil including a screen side bend portion, a neck side bend portion and a cone portion connecting the screen side bend portion and the neck side bend portion and is installed to a cathode ray tube. When viewing the screen side bend portion of the vertical deflecting coil from a screen side of the cathode ray tube in a direction along the tube axis, a distance between the screen side bend portion and the tube axis is the minimum at a portion close to a diagonal direction of the screen. As a result, the lateral inner pincushion distortion can be corrected with a magnetic field generated by the deflecting coil itself with a simple configuration, without adding any component for correcting the distortion and increasing a deflecting power.

14 Claims, 10 Drawing Sheets

DEFLECTION YOKE

BACKGROUND OF THE INVENTION

1. Field of the Invention

The present invention relates to a deflection yoke used for a cathode ray tube included in a television, a computer monitor and the like, and more particularly relates to a shape of a deflecting coil.

2. Related Background Art

FIG. 11 is a side view of a cathode ray tube device including a cathode ray tube and a deflection yoke, with an upper portion thereof broken away for clarity. The cathode ray tube 8 includes a glass bulb 3 and an electron gun 7 provided in a neck 4, where the glass bulb 3 further includes a display screen (phosphor screen) 2 inside of a front panel 1 and the electron gun 7 emits an electron beam 6 onto the display screen 2 through a shadow mask 5. A deflection yoke 9 is installed on a so-called cone unit of the cathode ray tube 8.

The deflection yoke 9 is assembled so that a horizontal deflecting coil 11 is located at the innermost position to contact with the cathode ray tube, and a separator 12, a vertical deflecting coil 13 and a core 14 are overlaid on the horizontal deflection coil 11 in the stated order. The separator 12 functions so as to insulate the horizontal deflecting coil 11 from the vertical deflecting coil 13 and fix them.

The horizontal deflecting coil and the vertical deflecting coil are saddle-type coils, and are each made up of a bend portion at a side of the front panel 1 (hereafter referred to as a "screen side bend portion"); a bend portion at a side of the electron gun 7 (hereafter referred to as a "neck side bend portion"); and a cone portion that connects the screen side bend portion and the neck side bend portion. Note here that the bend portion also is referred to as an arc portion.

FIG. 12 shows one of a pair of the vertical deflecting coils 13, as viewed from the screen side. The lateral axis in this figure corresponds to the X axis, the vertical axis corresponds to the Y axis, and the Z axis not illustrated in this drawing corresponds to the tube axis. In the deflection yoke having such a saddle-type vertical deflecting coil 13, the screen side bend portion 15 of the vertical deflecting coil 13 is approximately in the form of a segment of a circle, as shown in FIG. 12.

FIG. 13A shows the distortion of scanning lines on the screen, which is formed by the electron beam deflected by a deflection yoke that generates a normal self-convergence magnetic field. This distortion is called a "raster distortion". A lateral distortion as shown in FIG. 13A, resembling a bobbin, is called a "lateral (i.e., right and left) pincushion distortion" 16 and a distortion generated inside of the lateral pincushion distortion 16 is called a "lateral (i.e., right and left) inner pincushion distortion" 17.

Conventionally, well-known technology for correcting the lateral pincushion distortion 16 includes a method making use of a lateral pincushion distortion correction circuit that uses a configuration employing a pincushion transformer and for modulating a power supply voltage of a horizontal deflecting circuit in a TV set or a computer monitor set. These technologies are, for example, disclosed in JP6(1994)-315094 A and JP9(1997)-181931 A.

FIG. 13B illustrates a lateral inner pincushion distortion 18, which remains after the correction of a lateral pincushion distortion by means of the conventional lateral pincushion distortion correction circuit. Conventionally, methods for correcting such a lateral inner pincushion distortion 18 are, for example, as follows: that is, JP 9(1997)-149283 A discloses a technology of providing a correction coil in the deflection yoke. The correction coil provided is a reactor coil activated by a flow of a horizontal and vertical deflecting currents; and JP 7(1995)-39163 U discloses a technology of installing four magnets, two magnets of which installed along each of the X axis and the Y axis of the large-diameter side (i.e., screen side) of the deflection yoke.

However, according to the correction method disclosed in JP 7(1995)-39163 U, the magnets are added newly so as to correct the lateral inner pincushion distortion, which increases the number of components so that the structure would be complicated and also increases the number of assembling processes. Furthermore, if an error occurs during installation of the magnets, this error would cause a variation in the correction capability, which leads to a problem of a variation in the degree of a distortion of the displayed image. According to the correction method disclosed in JP 9(1997)-149283 A, the correction coil is added newly and the horizontal and vertical deflecting currents are used for the current supply of the coil, which would cause a problem of an increase in the deflecting power.

Also, since color cathode ray tubes used for the recent TVs and computer monitors are required to have a flatter screen and save space, the cathode ray tubes with a wider deflection angle have been developed. As a result, the deflection aberration is increased, so that the increase in the lateral inner pincushion distortion becomes a problem.

SUMMARY OF THE INVENTION

Therefore, with the foregoing in mind, it is an object of the present invention to provide a deflection yoke having the capability of correcting a lateral inner pincushion distortion in a simple configuration with a magnetic field generated by a deflecting coil itself, without adding a component for compensating the distortion and increasing a deflecting power.

To fulfill the above-stated object, a first deflection yoke according to the present invention, which is installed on a cathode ray tube, includes a saddle-type vertical deflecting coil including a screen side bend portion, a neck side bend portion and a cone portion connecting the screen side bend portion and the neck side bend portion. When viewing the screen side bend portion of the vertical deflecting coil from a screen side of the cathode ray tube in a direction along a tube axis, the screen side bend portion includes portions located on either side across an axis passing through the tube axis and extending along a diagonal direction of a screen and having a distance from the tube axis longer than a distance at a portion in the diagonal direction of the screen from the tube axis.

Next, a second deflection yoke according to the present invention, which is installed to a cathode ray tube, includes a saddle-type vertical deflecting coil including a screen side bend portion, a neck side bend portion and a cone portion connecting the screen side bend portion and the neck side bend portion. When viewing the screen side bend portion of the vertical deflecting coil from a screen side of the cathode ray tube in a direction along the tube axis, a distance from the tube axis is the minimum at a portion close to a diagonal direction of the screen of the screen side bend portion.

DETAILED DESCRIPTION OF THE INVENTION

Figure 1A:
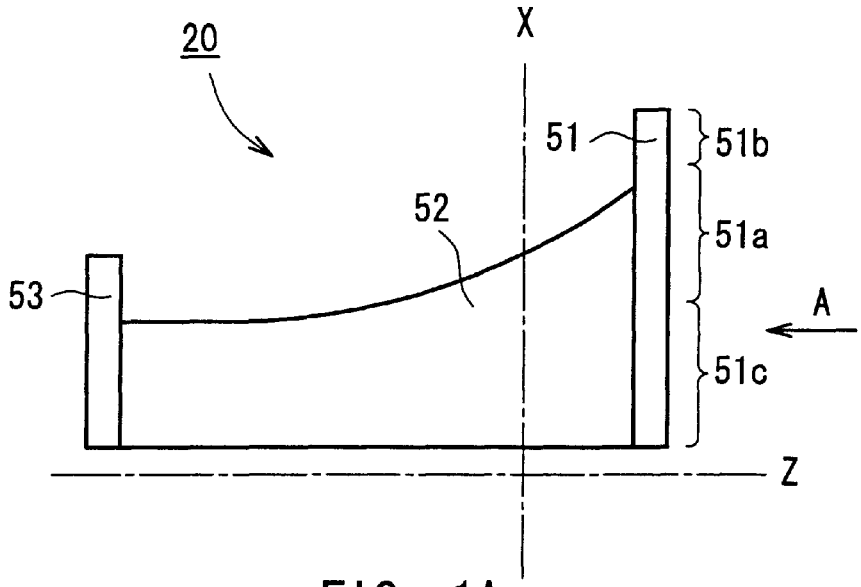
FIG. 1A is a side view of a vertical deflecting coil according to Embodiment 1 of the present invention.

According to the first invention of the present invention, the screen side bend portion includes portions located on either side across an axis passing through a tube axis and extending along a diagonal direction of a screen and having a distance from the tube axis longer than a distance between a portion located on the axis and the tube axis. According to the second invention of the present invention, a distance from the tube axis is the minimum at a portion of the screen side bend portion in a diagonal direction of the screen. With these configurations, a component X of a Lorentz force acting on an electron beam residing in a deflecting region becomes larger relatively at the portion in the diagonal direction of the screen, which results in a lateral inner pincushion distortion being smaller relative to a lateral pincushion distortion. Therefore, when the lateral pincushion distortion is corrected using the conventionally well-known lateral pincushion distortion correction circuit, the amount of remaining lateral inner pincushion distortion can be made small.

In the above-stated first invention, it is preferable that the distances recited therein are distances between the tube axis and an outer edge of the screen side bend portion corresponding to the respective portions.

In addition, it is preferable that the distances recited therein are distances between the tube axis and an inner edge of the screen side bend portion corresponding to the respective portions.

In the above-stated second invention, it is preferable that, when drawing a perpendicular line from an outer edge of the screen side bend portion to the tube axis, a length of the perpendicular line is the minimum at the portion in the diagonal direction of the screen.

In addition, it is preferable that, when drawing a perpendicular line from an inner edge of the screen side bend portion to the tube axis, a length of the perpendicular line is the minimum at the portion in the diagonal direction of the screen.

Further, in the above-stated first and second inventions, it is preferable that an edge portion of the screen side bend portion facing the screen side defines a single plane. In this configuration, the deflecting coil is formed so that the distance from the tube axis is longer at the portion in the diagonal direction of the screen than the other portions.

Moreover, it is preferable that an edge portion of the screen side bend portion facing the screen side is located on different planes between a portion close to the diagonal direction of the screen and the other portions. With this configuration, only the portion close to the diagonal direction of the screen is recessed toward the electron gun side, and the entire screen side bend portion can be configured along a separator, so that the distance from the tube axis can be made minimum at the portion of the screen side bend portion close to the diagonal direction of the screen. In addition, the entire of the screen side bend portion can be brought into intimate contact with the outer surface of the cathode ray tube or the separator, which does not cause a decrease in the efficiency of the deflecting energy.

In addition, it is preferable that the portion close to the diagonal direction of the screen is in approximately a straight line form, as viewed from the screen side of the cathode ray tube in the direction along the tube axis. With this configuration also, the distance from the tube axis can be made minimum at the portion of the screen side bend portion close to the diagonal direction of the screen.

Furthermore, it is preferable that the portion close to the diagonal direction of the screen is configured with at least a segment of a circle defining a convex protrusion toward the tube axis. With this configuration also, the distance from the tube axis can be made minimum at the portion of the screen side bend portion close to the diagonal direction of the screen.

Figure 11:
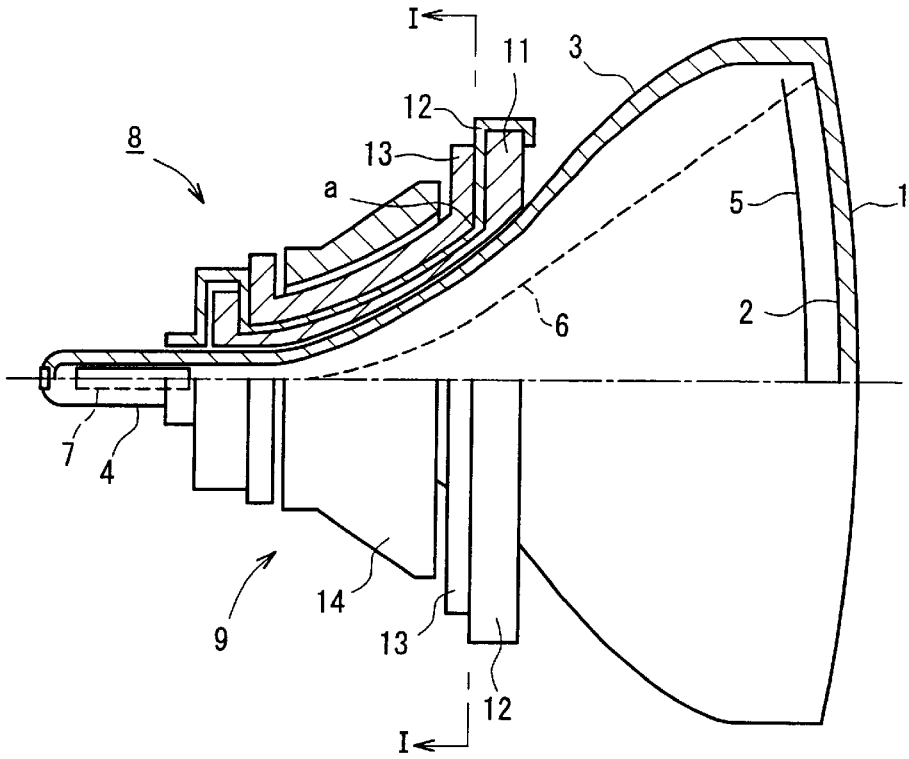
FIG. 11 PRIOR ART
FIG. 11 is a side view of an example of a cathode ray tube and a deflection yoke, with an upper portion thereof broken away for clarity.

The following describes embodiments of the present invention applied to a vertical deflecting coil, with reference to the drawings. Since the basic configuration of the cathode ray tube and the deflection yoke as described referring to FIG. 11 is applied also to the following embodiments, their explanations will be omitted, and a shape of the deflecting coil, which forms a feature of the present invention, will be described in detail.

Embodiment 1

Figure 1B:
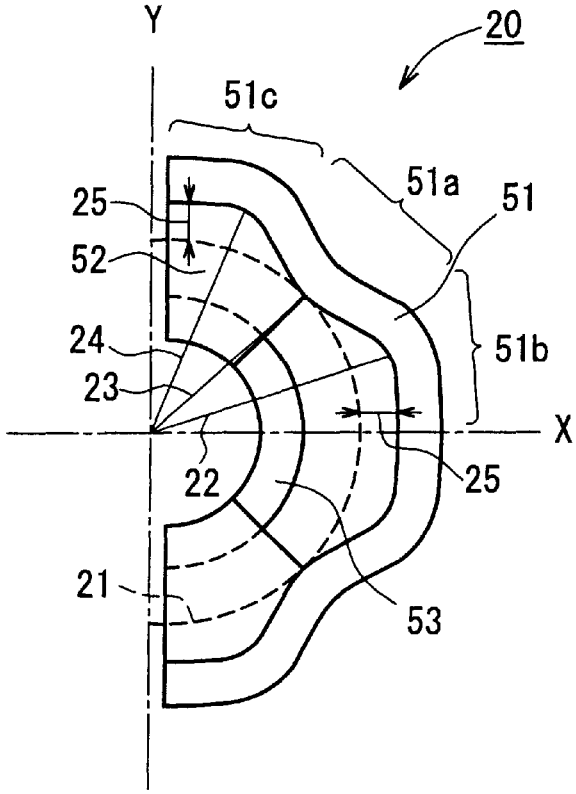
FIG. 1B is a view in the direction of the arrow A in FIG. 1A.

FIG. 1A is a diagrammatic side view of a vertical deflecting coil according to Embodiment 1, as viewed from the upper surface or the lower surface in the direction along the Y axis. FIG. 1B is a view in the direction of the arrow A in FIG. 1A, which is a diagrammatic front view of the vertical deflecting coil as viewed from the screen side of the cathode ray tube in the direction along the tube axis (the Z axis). Although the vertical deflecting coil according to this embodiment is made up of a pair of vertical deflecting coils opposed to each other, FIGS. 1A and 1B show a half of the vertical deflecting coils at one side, which applies to each of the following drawings.

The vertical deflecting coil 20 is made up of a screen side bend portion 51, a neck side bend portion 53, and a saddle-type cone portion 52 connecting the screen side bend portion 51 and the neck side bend portion 53.

An edge portion of the screen side bend portion 51 that faces the screen may be located on a plane orthogonal to the tube axis of the cathode ray tube. When viewing this portion from the screen side, as shown in FIG. 1B, the portion is configured so that a distance from the tube axis is the minimum at a portion 51*a* close to a diagonal direction and is made larger at a portion 51*b* close to the X axis and a portion 51*c* close to the Y axis. In other words, when drawing a perpendicular line (i.e., a line intersecting with the tube axis at right angles) from an inner or an outer edge of the screen side bend portion to the tube axis, the length of the perpendicular line becomes the minimum at the portion 51*a* close to the diagonal direction.

More specifically, as shown in FIG. 1B, among the perpendicular lines residing in the first (upper right) quadrant divided by the X axis and the Y axis, the length of the perpendicular line at the portion 51*a* close to the diagonal direction is the minimum, which is shorter than those of the perpendicular line 22 at the portion 51*b* close to the X axis and the perpendicular line 24 at the portion 51*c* close to the Y axis.

Although FIG. 1B illustrates an example where the perpendicular lines are drawn from the inner edge of the screen side bend portion, even in the case of perpendicular lines drawn from the outer edge of the screen side bend portion, the length of the perpendicular line becomes the minimum also at the portion 51*a* close to the diagonal direction.

Note here that the diagonal direction is a direction along the diagonal line of the screen. Also, the portion close to the diagonal direction is an area of the screen side bend portion located around the axis passing through the tube axis and extending along the diagonal direction. More specifically, when pivoting the axis along the diagonal direction about 10 degrees clockwise and counterclockwise about a point on the tube axis, the portion close to the diagonal direction is defined as the area where the pivoted axis and the screen side bend portion overlap with each other.

Although the above-described example deals with the case of the first quadrant, the screen side bend portion has the configuration having the minimum distance at the portion close to the diagonal direction also in the second (upper left), the third (lower left) and the fourth (lower right) quadrants.

To realize this configuration, the portion 51*a* close to the diagonal direction may be brought into intimate contact with rim 21 (corresponding to the portion a in FIG. 11) of the separator 12, while providing an air gap 25 between the portion 51*b* close to the X axis or the portion 51*c* close to the Y axis and the rim 21 of the separator 12 so as to increase the distance from the tube axis.

Figure 2:
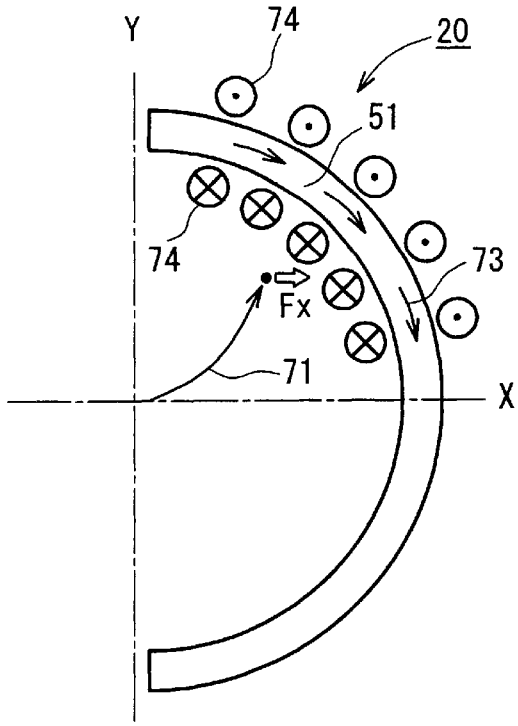
FIG. 2 shows a relationship between the magnetic field generated by the screen side bend portion of the vertical deflecting coil and the Lorentz forces acting on the electron beams.

The following describes a function of correcting a lateral inner pincushion distortion using the vertical deflecting coil of the present invention. FIG. 2 shows a trace of an electron beam 71 deflected toward the upper right quadrant (viewed from the screen side) of the screen by the deflecting magnetic field, a direction of a deflecting current 73 flowing through the screen side bend portion 51 of the vertical deflecting coil, a direction of the magnetic field 74 generated from the screen side bend portion 51, and a component Fx in the X direction of the Lorentz force acting on an electron beam residing in the magnetic field. In this drawing, a black dot denotes a cross-section of an electron beam, and an open arrow denotes a Lorentz force. It is known that the component Fx in the X direction of the Lorentz force acting on an electron beam residing in the magnetic field can be represented by the following formula (1):

$$Fx=-e\times Vy\times Bz \tag{1}$$

where e denotes the amount of electric charge, Vy denotes a Y component of the speed of an electron, and Bz denotes a Z component of the magnetic field.

Figure 3:
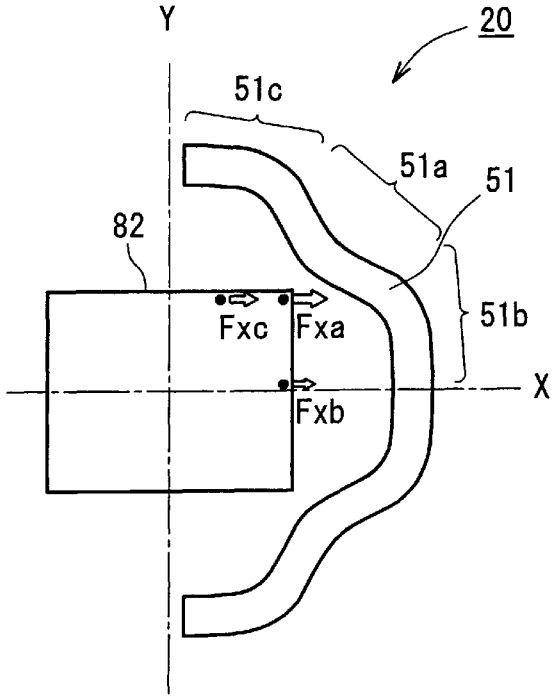
FIG. 3 shows a relationship between the shape of the screen side bend portion of the vertical deflecting coil according to the present invention and the Lorentz forces acting on the electron beams residing in the deflecting region.

According to the present invention, the shape of the screen side bend portion 51 is contrived so that the Lorentz force Fx is increased or decreased for each position on the screen. FIG. 3 shows a relationship among a shape of the screen side bend portion 51, which is included in one half of the vertical deflecting coil of the present invention, a region for deflection 82 where an electron beam is deflected, and the Lorentz forces Fx acting on electron beams residing at three points in the region for deflection 82. Here, the electron beams are represented by the black dots and the Lorentz forces Fx are represented by the open arrows. The electron beams are deflected within the region for deflection 82 by the deflecting magnetic field. Within the region for deflection 82, the magnitude Bz of the magnetic field at a portion close to an upper edge portion of an area where the lateral inner pincushion distortion is generated, and an X component Fx of the Lorentz force acting thereon are assumed as Bzc and Fxc, respectively. Similarly, the Bz at a portion close to a corner of the diagonal line and the Fx acting thereon are assumed as Bza and Fxa, respectively, and the Bz at a portion close to the end of the X axis and the Fx acting thereon are assumed as Bzb and Fxb, respectively.

As shown in FIG. 3, since the distance between the screen side bend portion 51 and the electron beam becomes the minimum at the corner of the region for deflection 82 along the diagonal direction or the portion around the corner, the magnitude correlation among the Z components of the magnetic fields generated by the screen side bend portion 51 becomes Bza>Bzb and Bza>Bzc. Then, from the formula (1), the magnitude correlation among the X components of the Lorentz forces acting on the electron beams becomes Fxa>Fxb and Fxa>Fxc.

Figure 4A:
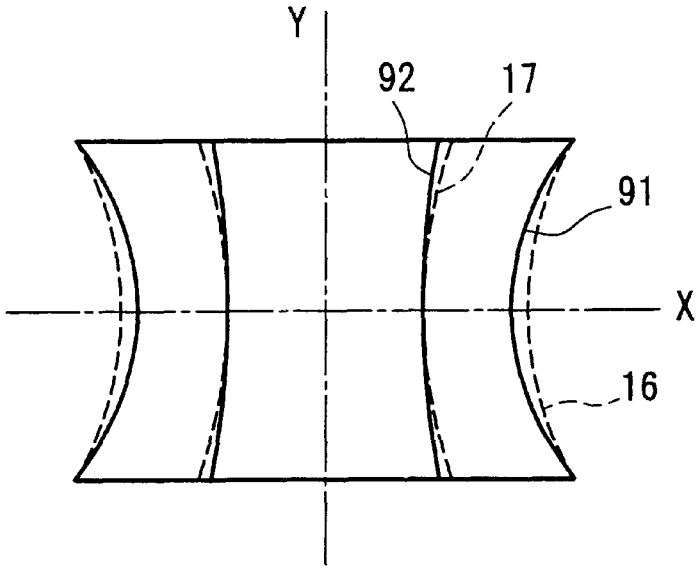
FIG. 4A shows a comparison between the prior art and the present invention, illustrating lateral pincushion distortions and lateral inner pincushion distortions in both cases before the correction of the lateral pincushion distortion using the circuit.

In addition, since the distance from the portion 51*b* close to the X axis or the portion 51*c* close to the Y axis to the tube axis is set longer, Fxb and Fxc become smaller compared with the conventional case where these portions are brought into intimate contact with the separator 12. FIG. 4A is a comparison result with the conventional vertical deflection coil having a screen side bend portion in the form of approximately a segment of a circle. As shown in FIG. 4A, the lateral (i.e., right and left) pincushion distortion is increased from the conventional curve 16 indicated by the broken line to the curve 91 indicated by the solid line, because Fxb is decreased. The lateral (i.e., right and left) inner pincushion distortion is decreased from the conventional curb 17 indicated by the broken line to the curve 92 indicated by the solid line, because Fxc is decreased.

Figure 4B:
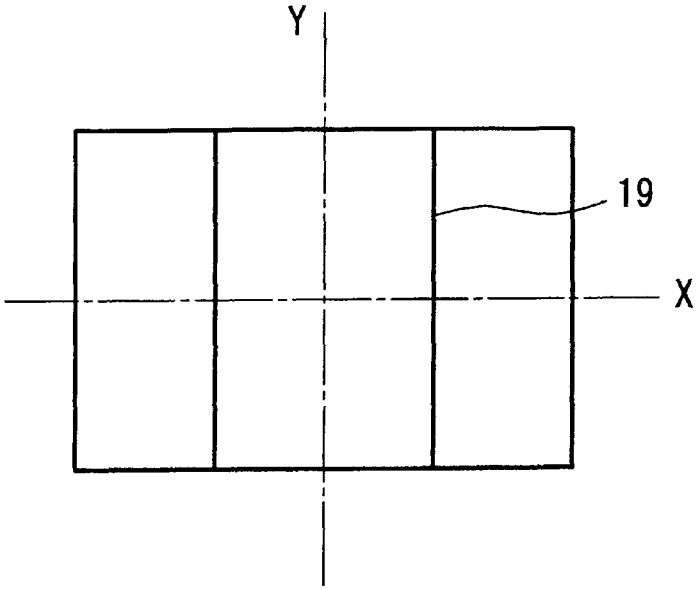
FIG. 4B shows a state where the lateral inner pincushion distortion is corrected in the present invention by correcting the lateral pincushion distortion using the circuit.
Figure 13A:
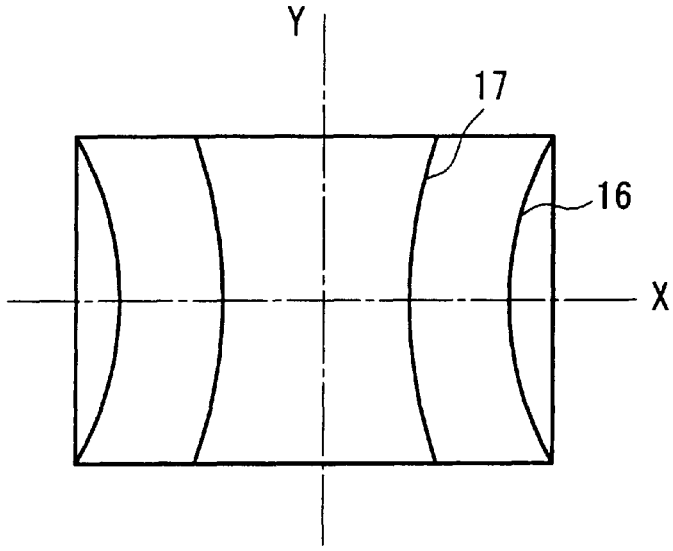
FIG. 13A PRIOR ART
FIG. 13A shows a lateral pincushion distortion and a lateral inner pincushion distortion generated due to the self-convergence magnetic field.
Figure 13B:
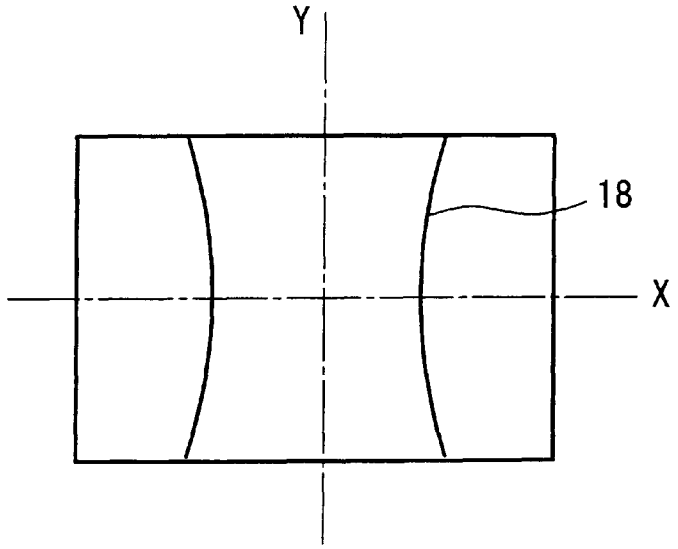
FIG. 13B PRIOR ART
FIG. 13B shows the lateral inner pincushion distortion remaining after the correction of the lateral pincushion distortion using a circuit.

In this way, according to the present invention, the lateral pincushion distortion is increased as compared with the conventional one, while the lateral inner pincushion distortion is decreased as compared with the conventional one. Therefore, the lateral pincushion distortion and the lateral inner pincushion distortion can be corrected appropriately at the same time using the conventionally well-known lateral pincushion distortion correction circuit. According to the present invention, the lateral inner pincushion distortion becomes smaller relative to the lateral pincushion distortion. Accordingly, when the lateral pincushion distortion is corrected so as to be a straight line using the above-stated lateral pincushion distortion correction circuit conventionally used, the amount of correction for the lateral pincushion distortion is increased compared with the conventional case, but a smaller amount of correction for the lateral inner pincushion distortion to be corrected concurrently is sufficient compared with the conventional case. Therefore, the lateral inner pincushion distortion does not remain after the correction of the lateral pincushion distortion as in the case of the conventional one (FIG. 13B), but the lateral inner pincushion distortion also can be corrected to a straight line 42 as shown in FIG. 4B.

Embodiment 2

Figure 5A:
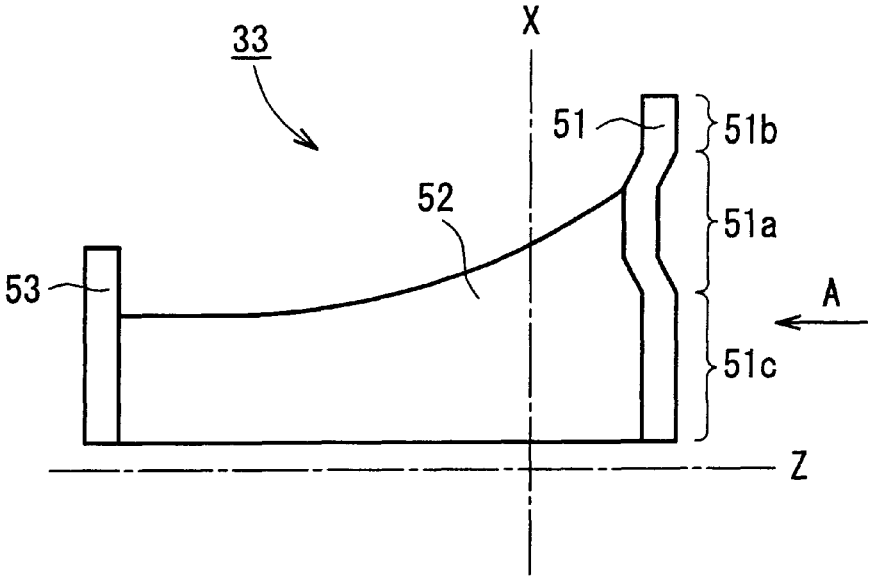
FIG. 5A is a side view of a vertical deflecting coil according to Embodiment 2 of the present invention.
Figure 5B:
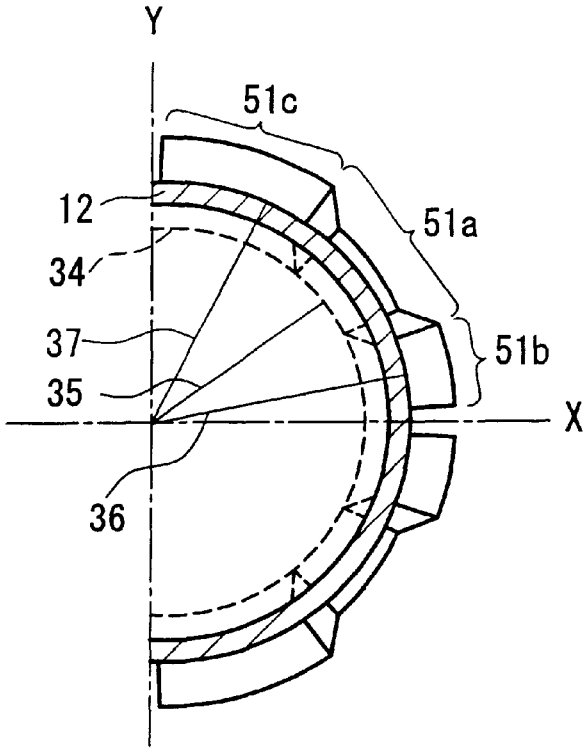
FIG. 5B is a view in the direction of the arrow A in FIG. 5A.

FIG. 5A is a side view of a vertical deflecting coil according to Embodiment 2, as viewed from the upper or the lower surface. FIG. 5B shows a state where the vertical deflecting coil shown in FIG. 5A is installed with the separator 12 as viewed from the direction of the arrow A. This drawing corresponds to the cross-sectional view taken along the line I—I of FIG. 11.

Unlike Embodiment 1 where the edge portion of the screen side bend portion 51 that faces the screen is located on a single plane orthogonal to the tube axis, an edge portion of the screen side bend portion 51 that faces the screen in this embodiment is located not on the same plane, but a portion close to a diagonal line of the display screen and the other portions are located on different planes from each other as shown in FIG. 5A.

In the screen side bend portion 51, the portion 51*b* close to the X axis and the portion 51*c* close to the Y axis are located on the same plane, but only the portion 51*a* close to the diagonal direction is provided so as to be recessed toward the electron gun side. The outer diameter of the separator at the portion 51*a* close to the diagonal direction is smaller relative to those at the portion 51*b* close to the X axis and the portion 51*c* close to the Y axis. This is because, since the portion of the cathode ray tube where the deflection yoke is mounted is conical or a pyramid in shape, the outer diameter of the cathode ray tube, i.e., the outer diameter of the separator decreases with increasing the proximity to the electron gun.

Therefore, when forming the screen side bend portion 51 so that the contour of the entire inner surface is along the separator, then the shape of the screen side bend portion 51 as viewed from the screen side becomes like in FIG. 1B where the distance from the tube axis becomes the minimum at the portion 51*a* close to the diagonal direction. In other words, when drawing a perpendicular line from an inner or an outer edge of the screen side bend portion 51 to the tube axis, the length of the perpendicular line becomes the minimum at the portion close 51*a* to the diagonal direction.

FIG. 5B shows this aspect specifically. A broken line 34 represents the outer diameter of a portion of the separator 12 that is recessed toward the electron gun side. The inner edge of the portion 51*a* close to the diagonal direction of the bend portion 51 comes into contact with the separator 12 at the position represented by the broken line 34. That is to say, the length of a perpendicular line 35 drawn from the portion 51*a* close to the diagonal line to the tube axis becomes shorter than those of a perpendicular line 36 drawn from the inner edge of the portion 51*b* close to the X axis to the tube axis and a perpendicular line 37 drawn from the inner edge of the portion 51*c* close to the Y axis to the tube axis.

As in the case of Embodiment 1, the magnitude correlation among the Lorentz forces Fx acting on the electron beams becomes Fxa>Fxb and Fxa>Fxc, whereby the lateral inner pincushion distortion can be mitigated.

In the case of Embodiment 1, in order to set the distance between the tube axis and the portion 51*a* close to the diagonal direction at the minimum, air gaps larger than necessary have to be provided between the portion 51*b* close to the X axis or the portion 51*c* close to the Y axis and the separator 12. On the contrary, according to this embodiment, the entire contour of the screen side bend portion 51 can be brought into intimate contact with the separator 12, and therefore an advantageous effect of preventing a decrease in the efficiency of the deflecting energy can be produced.

Embodiment 3

Figure 6A:
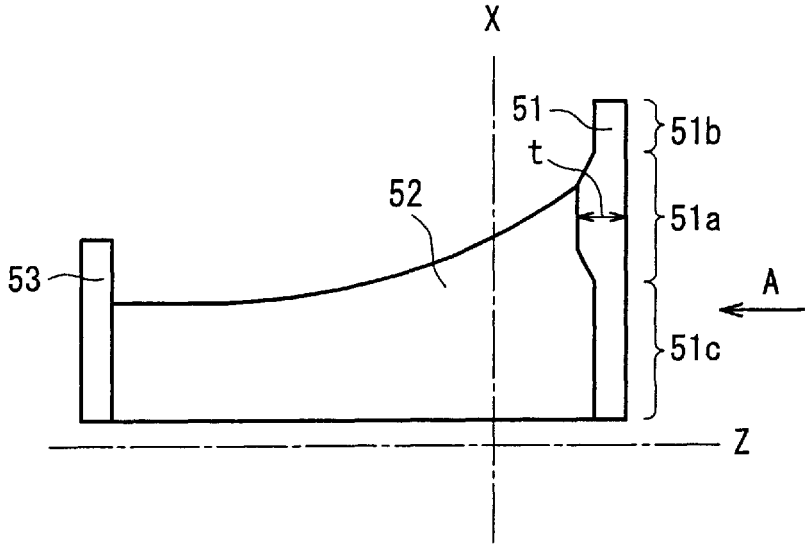
FIG. 6A is a side view of a vertical deflecting coil according to Embodiment 3 of the present invention.
Figure 6B:
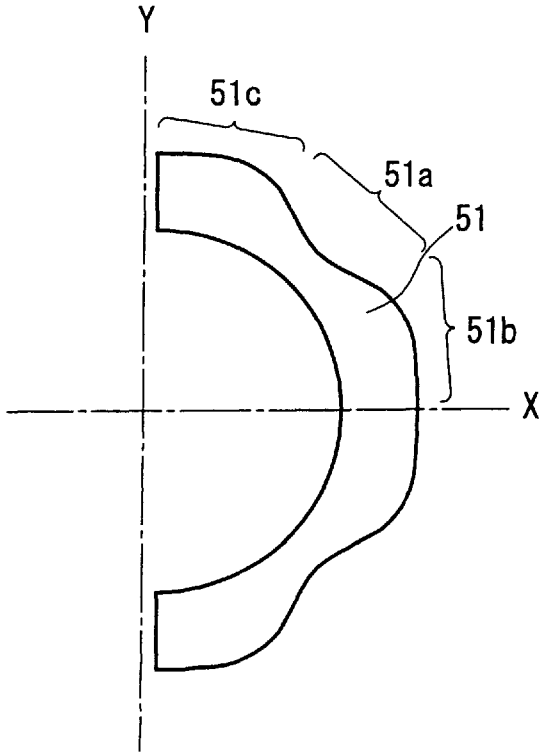
FIG. 6B is a view in the direction of the arrow A in FIG. 6A.

FIG. 6A is a side view of a vertical deflecting coil according to Embodiment 3 as viewed from the upper or the lower surface, and FIG. 6B is a view in the direction of the arrow A in FIG. 6A.

In this embodiment, the thickness t in the tube axis direction of the screen side bend portion 51 is made larger at the portion 51*a* close to the diagonal direction relative to the other portions 51*b* and 51*c*. Such an increase in the thickness t in the tube axis direction at the portion 51*a* close to the diagonal direction enables a decrease in the thickness in the radial direction at the corresponding portion. Thus, as shown in FIG. 6B, while keeping the inner diameter of the screen side bend portion 51 in the form of approximately a segment of a circle, the distance between the tube axis and the outer edge of the screen side bend portion 51 can be made smaller only at the portion 51*a* close to the diagonal line.

As in the case of Embodiments 1 and 2, the magnitude correlation among the Lorentz forces Fx acting on the electron beams becomes Fxa>Fxb and Fxa>Fxc, whereby the lateral inner pincushion distortion can be mitigated.

As forms for making the thickness t in the tube axis direction of the portion 51*a* close to the diagonal direction larger relative to those of the portion 51*b* close to the X axis and the portion 51*c* close to the Y axis, two forms are available. One is to make the thickness t of the portion 51*a* close to the diagonal direction larger than the conventional deflecting coil, and the other is to make the thicknesses t of the portion 51*b* close to the X axis and the portion 51*c* close to the Y axis smaller so as to make the thickness in the radial direction larger. Between them, the latter has the effect of increasing the surface area of the screen side bend portion, which can enhance the thermal dissipation therefrom and can suppress an increase in the temperature of the deflecting coil.

In addition, according to this embodiment, since the inner edge of the screen side bend portion 51 is in the form of a segment of a circle like Embodiment 2, the entire contour of the screen side bend portion 51 can be brought into intimate contact with the separator 12.

Embodiment 4

Figure 7:
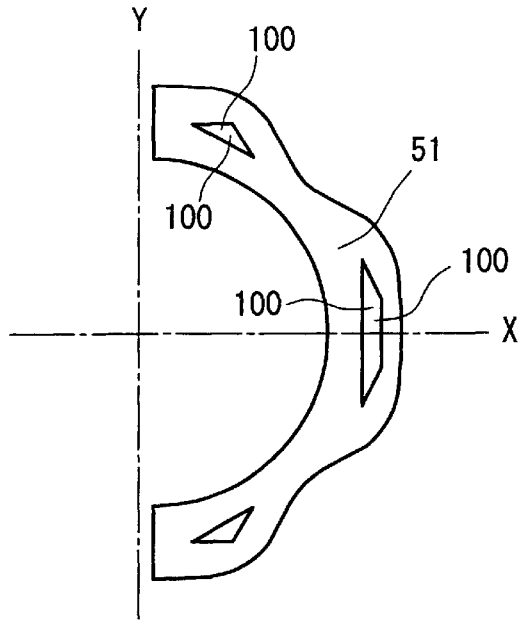
FIG. 7 is a front view of a vertical deflecting coil according to Embodiment 4 of the present invention.

FIG. 7 is a front view of a vertical deflecting coil according to Embodiment 4.

In this embodiment, a space 100 where coil winding is not present is formed at each of portions in the screen side bend portion 51 close to the X axis and the Y axis. By providing these spaces 100, the thus obtained configuration substantially is the same as in that the distance from the tube axis is made minimum at the portion 51*a* close to the diagonal direction, and therefore the magnitude of the magnetic field at the portion close to the diagonal direction can be increased relatively as in the case of the above-stated embodiments.

According to this embodiment, the magnitude correlation among the Lorentz forces Fx acting on the electron beams becomes Fxa>Fxb and Fxa >Fxc, whereby the lateral inner pincushion distortion can be mitigated.

Also, the provision of the spaces 100 can produce the effect of increasing the surface area of the deflecting coil, which can enhance the thermal dissipation therefrom and can suppress an increase in the temperature of the deflecting coil.

Embodiment 5

Figure 8:
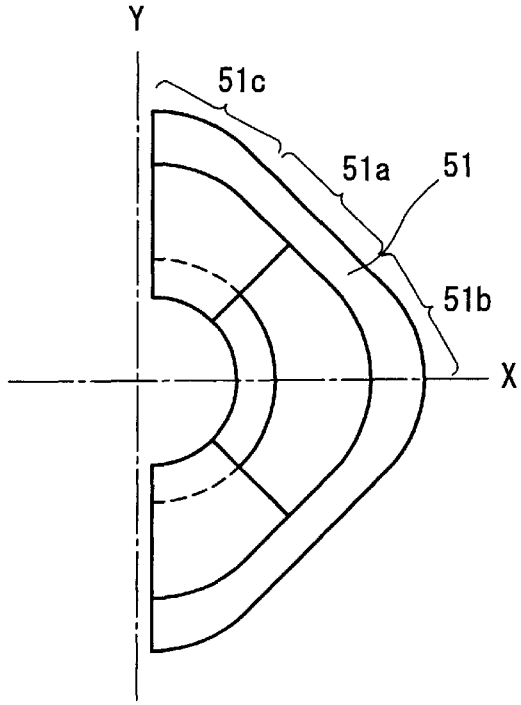
FIG. 8 is a front view of a vertical deflecting coil according to Embodiment 5 of the present invention.

FIG. 8 is a front view of a vertical deflecting coil according to Embodiment 5. In this embodiment, the portion 51*a* close to the diagonal direction is in the straight line form, so that the distance between the tube axis and the portion 51*a* close to the diagonal direction is made at the minimum, whereby the magnitude of the magnetic field at that portion can be increased relatively.

Embodiment 6

In the above-described embodiments, the distance from the screen side bend portion to the tube axis becomes the minimum at the portion close to the diagonal direction of the screen. Meanwhile, the screen side bend portion of Embodiment 6 includes portions located on either side across the axis passing through the tube axis and extending along the diagonal direction of the screen, and having a distance from the tube axis longer than a distance between a portion located on the axis and the tube axis.

Figure 9:
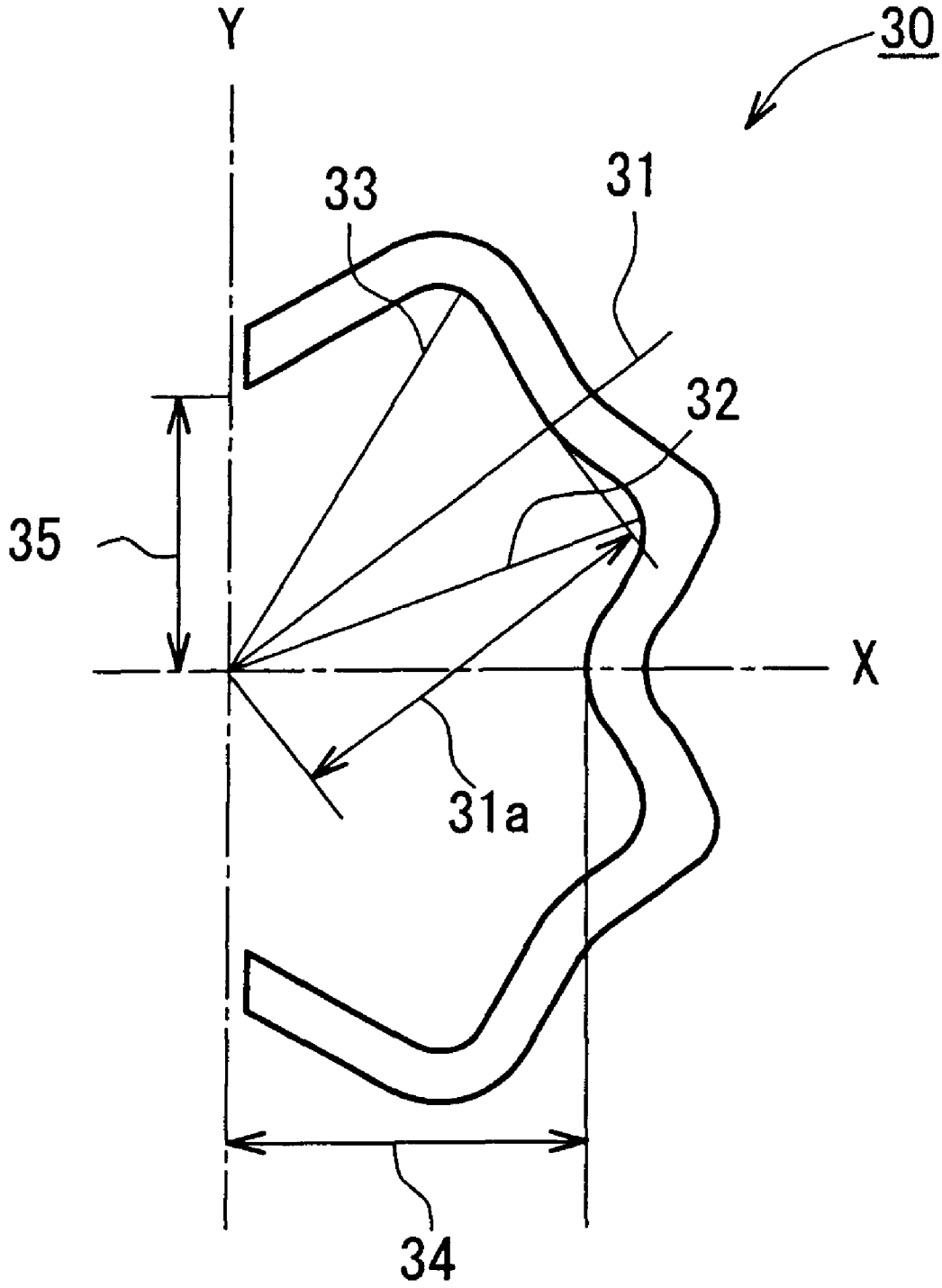
FIG. 9 is a front view of a vertical deflecting coil according to Embodiment 6 of the present invention.

FIG. 9 is a front view of a vertical deflecting coil 30 according to Embodiment 6. In this drawing, an axis 31 is the axis passing through the tube axis and extending along the diagonal direction of the screen. Lines 32 and 33 are perpendicular lines drawn from the inner edge of the portions of the screen side bend portion located on either side across the axis 31. The lengths of the lines 32 and 33 are longer than that of the length 31*a* along the axis 31 between the tube axis and the inner edge of the screen side bend portion.

This dimensional relationship is the same as in the above-stated embodiments. However, according to this embodiment, although the length 31*a* is shorter than those of the line 32 and line 33, this length is not the minimum value among the distances between the tube axis and the inner edge of the screen side bend portion. In an example shown in FIG. 9, the length 31*a* is longer than the length 34 along the X axis and the length 35 along the Y axis.

It is preferable that the length 31*a* is the minimum value as in the above-described embodiments. However, even if the length 31*a* is not the minimum value, insofar as the screen side bend portion is configured so as to include portions located on either side across the axis 31 extending along the diagonal direction and having lengths 32 and 33 longer than the length 31*a*, the magnetic field generated by such a vertical deflecting coil itself can correct the lateral inner pincushion distortion.

Note here that although this embodiment deals with the distance between the tube axis and the inner edge of the screen side bend portion, the same applies to the case of the distance between the tube axis and the outer edge of the screen side bend portion. Furthermore, this embodiment can be combined with any one of Embodiments 2 to 5.

Figure 10:
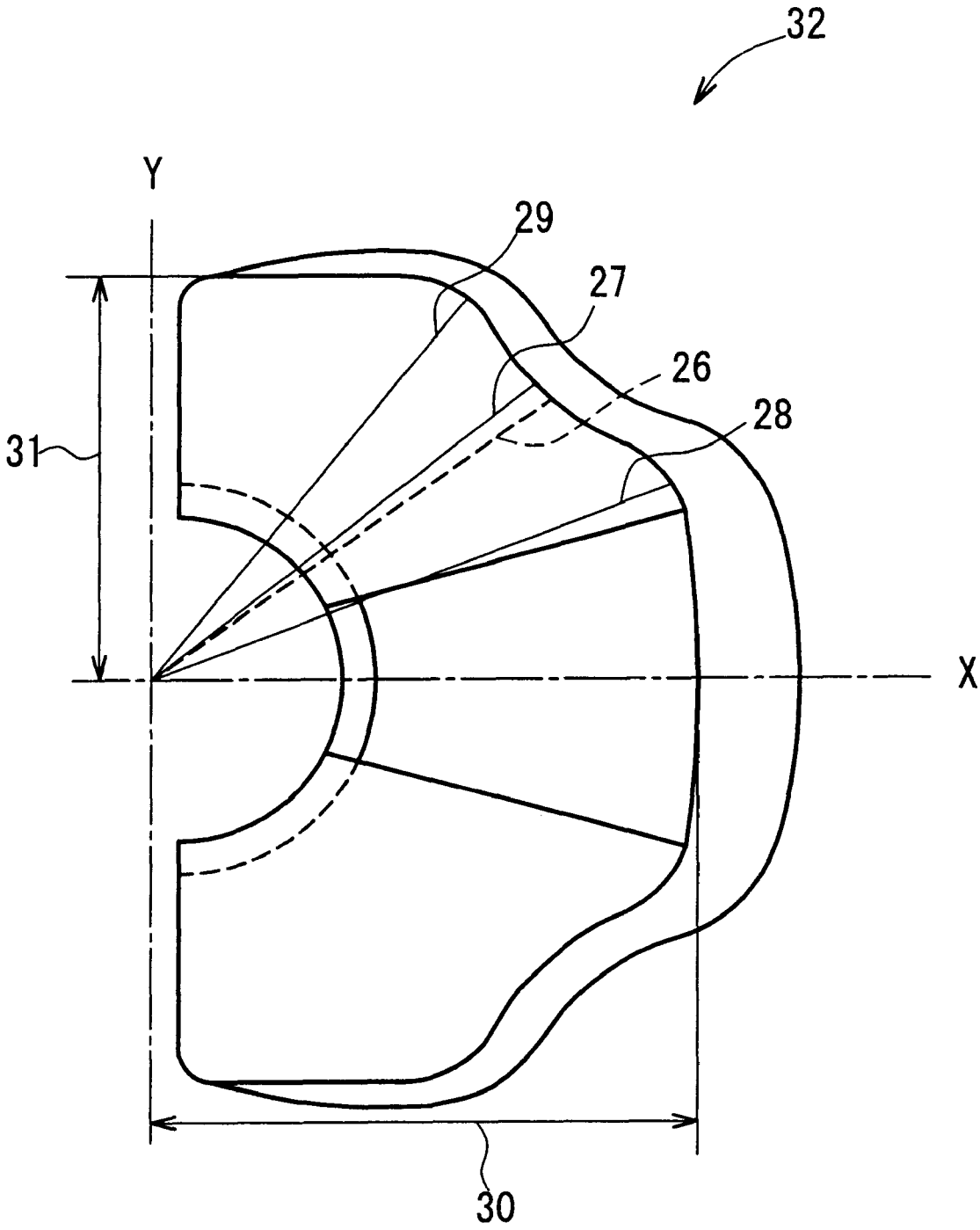
FIG. 10 shows an embodiment of a vertical deflecting coil according to the present invention.

FIG. 10 shows one example of a shape and dimensions of the screen side bend portion 51 of a vertical deflecting coil used in a deflection yoke for 46 cm (or 19-inch) color cathode ray tubes. In FIG. 10, a line 26 is a perpendicular line drawn from the inner edge of the bend portion to the tube axis in the direction along the diagonal direction, a line 27 is a perpendicular line drawn from the inner edge of the portion close to the diagonal direction to the tube axis, a line 28 is a perpendicular line drawn from the inner edge of the portion close to the X axis to the tube axis, a line 29 is a perpendicular line drawn from the inner edge of the portion close to the Y axis to the tube axis, a length 30 is the length along the X axis between the tube axis and the inner edge of the bend portion and a length 31 is the length along the Y axis between the tube axis and the inner edge of the bend portion.

According to this embodiment, the length of the line 26 is 55.972 mm, the length of the line 27 is 55.633 mm, the length of the line 28 is 63.374 mm, the length of the line 29 is 56.962 mm, the length 30 is 61.458 mm, and the length 31 is 47.622 mm. In this way, the length of the line 27 at the portion close to the diagonal direction is shorter than the lengths of the line 28 at the portion close to the X axis and the line 29 at the portion close to the Y axis.

Having such a dimensional relationship, the bend portion is, as shown in FIG. 10, in the form of a segment of a circle defining a convex protrusion toward the tube axis at the portion close to the diagonal direction.

Figure 12:
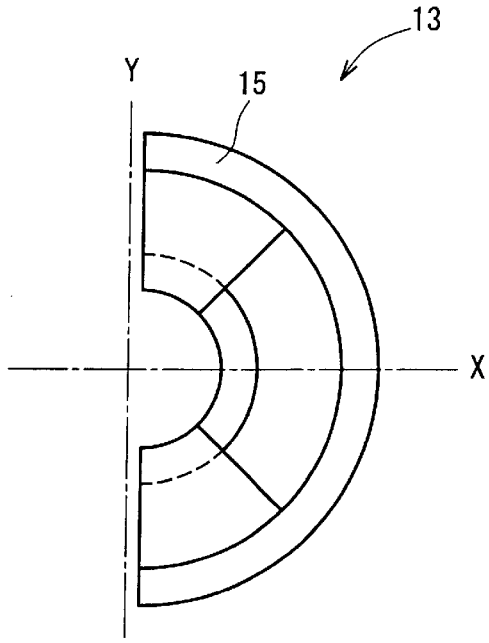
FIG. 12 PRIOR ART
FIG. 12 is a front view showing one of a pair of conventional vertical deflecting coils.

In the case of the conventional deflection yoke having a screen side bend portion in the form of approximately a circle (FIG. 12), the generated lateral pincushion distortion, which is represented by the maximum value of a displacement from the ideal straight line, was 15.5 mm, and the lateral inner pincushion distortion was 6.7 mm. Then, after the correction of the lateral pincushion distortion using the lateral pincushion distortion correction circuit, the lateral inner pincushion distortion became 0.8 mm. On the other hand, according to the above-described embodiment of the present invention, the lateral pincushion distortion was 15.9 mm and the lateral inner pincushion distortion was 6.4 mm. After the correction using the conventional lateral pincushion distortion correction circuit, the lateral inner pincushion distortion became 0.4 mm. That is to say, while the lateral pincushion distortion before the correction was increased by 0.4 mm, the lateral inner pincushion distortion before the correction was decreased by 0.3 mm. Then, the remaining lateral inner pincushion distortion after the correction of the lateral pincushion distortion to a straight line using the lateral pincushion distortion correction circuit was decreased by 0.4 mm.

As stated above, according to the present invention, the magnetic field generated by the vertical deflecting coil itself allows the lateral inner pincushion distortion to be mitigated relatively. Therefore, without adding a surplus component and increasing the deflecting power, the lateral inner pincushion distortion can be mitigated using the general lateral pincushion distortion correction circuit.

It should be noted here that a vertical pincushion distortion also can be corrected by applying the present invention to a horizontal deflecting coil.

In this way, according to the present invention, without the need to add a surplus component such as a correcting coil and a magnet, the deflection yoke in a simple configuration is provided, which includes the deflecting coil that generates the magnetic field to mitigate the lateral inner pincushion distortion as a deflected image distortion.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A deflection yoke installed on a cathode ray tube, comprising a saddle-type vertical deflecting coil including a screen side bend portion, a neck side bend portion and a cone portion connecting the screen side bend portion and the neck side bend portion, wherein, when viewing the screen side bend portion of the vertical deflecting coil from a screen side of the cathode ray tube in a direction along a tube axis, the screen side bend portion includes portions located on either side across an axis passing through the tube axis and extending along a diagonal direction of a screen and having a distance from the tube axis longer than a distance at a portion in the diagonal direction of the screen from the tube axis.

2. The deflection yoke according to claim 1, wherein the distances recited therein are distances between the tube axis and an outer edge of the screen side bend portion corresponding to the respective portions.

3. The deflection yoke according to claim 1, wherein the distances recited therein are distances between the tube axis and an inner edge of the screen side bend portion corresponding to the respective portions.

4. The deflection yoke according to claim 1, wherein an edge portion of the screen side bend portion facing the screen side defines a single plane.

5. The deflection yoke according to claim 1, wherein an edge portion of the screen side bend portion facing the screen side is located on different planes between a portion close to the diagonal direction of the screen and the other portions.

6. The deflection yoke according to claim 1, wherein a portion close to the diagonal direction of the screen is in approximately a straight line form, as viewed from the screen side of the cathode ray tube in the direction along the tube axis.

7. The deflection yoke according to claim 1, wherein a portion close to the diagonal direction of the screen is configured with at least a segment of a circle defining a convex protrusion toward the tube axis.

8. A deflection yoke installed on a cathode ray tube, comprising a saddle-type vertical deflecting coil including a screen side bend portion, a neck side bend portion and a cone portion connecting the screen side bend portion and the neck side bend portion, wherein, when viewing the screen side bend portion of the vertical deflecting coil from a screen side of the cathode ray tube in a direction along a tube axis, a distance from the tube axis is at a minimum at a portion of the screen side bend portion close to a diagonal direction of a screen.

9. The deflection yoke according to claim 8, wherein when drawing a perpendicular line from an outer edge of the screen side bend portion to the tube axis, a length of the perpendicular line is at a minimum at the portion close to the diagonal direction of the screen.

10. The deflection yoke according to claim 8, wherein when drawing a perpendicular line from an inner edge of the screen side bend portion to the tube axis, a length of the perpendicular line is at a minimum at the portion close to the diagonal direction of the screen.

11. The deflection yoke according to claim 8, wherein an edge portion of the screen side bend portion facing the screen side defines a single plane.

12. The deflection yoke according to claim 8, wherein an edge portion of the screen side bend portion facing the screen side is located on different planes between the portion close to the diagonal direction of the screen and the other portions.

13. The deflection yoke according to claim 8, wherein the portion close to the diagonal direction of the screen is in approximately a straight line form, as viewed from the screen side of the cathode ray tube in the direction along the tube axis.

14. The deflection yoke according to claim 8, wherein the portion close to the diagonal direction of the screen is configured with at least a segment of a circle defining a convex protrusion toward the tube axis.

* * * * *